US008135529B2

(12) United States Patent
Liao et al.

(10) Patent No.: US 8,135,529 B2
(45) Date of Patent: Mar. 13, 2012

(54) METHOD FOR CONTROLLING CONSTANT-PRESSURE FLUID

(75) Inventors: Shih-Chieh Liao, Taoyuan Shien (TW); Jen-Hsiang Huang, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 789 days.

(21) Appl. No.: 12/235,705

(22) Filed: Sep. 23, 2008

(65) Prior Publication Data

US 2010/0076658 A1 Mar. 25, 2010

(51) Int. Cl.
*F04B 49/00* (2006.01)

(52) U.S. Cl. ..... 701/78; 417/44.2; 417/12; 417/15

(58) Field of Classification Search ..... 701/78; 417/44.2, 12, 15; *F04B 49/00*
See application file for complete search history.

(56) References Cited

U.S. PATENT DOCUMENTS 4,627,243 A * 12/1986 Schaub ..... 62/50.2
4,788,448 A * 11/1988 Crowe ..... 307/31
4,874,294 A * 10/1989 Karg ..... 417/12
5,092,824 A * 3/1992 Connett ..... 475/72
5,244,350 A * 9/1993 Yang ..... 417/12
5,282,722 A * 2/1994 Beatty ..... 417/15
5,580,221 A * 12/1996 Triezenberg ..... 417/44.2
6,994,537 B2 * 2/2006 Liu et al. ..... 425/143
8,070,459 B2 * 12/2011 Tollner ..... 417/53
2009/0266934 A1 * 10/2009 Makino ..... 244/99.5
2009/0280014 A1 * 11/2009 Branecky ..... 417/43
2010/0043409 A1 * 2/2010 Naydenov et al. ..... 60/287
2010/0303636 A1 * 12/2010 Tamai et al. ..... 417/32
2011/0008187 A1 * 1/2011 Infanger ..... 417/280
2011/0110791 A1 * 5/2011 Donnat et al. ..... 417/18

* cited by examiner

*Primary Examiner* — Tuan C. To
(74) *Attorney, Agent, or Firm* — Chun-Ming Shih; HDLS IPR Services

(57) ABSTRACT

A method for controlling a constant-pressure fluid enables an inverter with a build-in controller to control rotation speed of a pump to achieve constant-pressure control thereof. In the control method, a pressure feedback value of output flow of the pump is measured and is compared with a pressure reference value to produce an error pressure value. Afterward, an operation condition of the pump, such as an abnormal handling condition, a deceleration standby handling condition, or an acceleration condition, is determined according to the pressure error value to shut down or re-start up the pump after a delay time. Hence, the control method can avoid frequently starting up or shutting down the inverter. Therefore, the power consumption and the operation cost are reduced. The use life of the pump prolongs and constant-pressure control for the pump can be implemented.

5 Claims, 5 Drawing Sheets

METHOD FOR CONTROLLING CONSTANT-PRESSURE FLUID

BACKGROUND OF THE INVENTION

1. Field of the Invention

The present invention relates to a method for controlling a constant-pressure fluid, and more particularly to a method for controlling a constant-pressure fluid, whereby an inverter with a build-in controller is provided to control rotation speed of a pump.

2. Description of Related Art

In the present day, primary demands of a constant-pressure water supply system are how to maintain a constant-pressure condition, how and when to detect a normal and abnormal operation condition. Hence, a controller is used to adjust an output frequency of an inverter to control rotation speed of a pump according to a variation quantity of water pressure.

Reference is made to FIG. 1 which is a block diagram of a related art constant-pressure water supply system. The constant-pressure water supply system comprises a pump 10A, a pressure gauge 12A, a controller 14A, and an inverter 16A. The pump 10A is used to pump water from an external water source. The pressure gauge 12A is used to measure a water pressure value of a pipe connected to the pump 10A, and the water pressure value is converted into a feedback pressure value. The controller 14A is used to receive the feedback pressure value and the feedback pressure value is operated to adjust an output frequency of the inverter 16A. Therefore, the rotation speed of the pump 10A can be controlled in the constant-pressure condition.

Although many different types of the controllers 14A have been designed, the PID controller is applied generally in industrial automation field, and more particularly to temperature, pressure, and fluid control. The PID controller has some advantages: lower cost, better control performance, less tune parameters, and better anti-interference function.

However, in the related art constant-pressure water supply system, the controller 14A is connected between the pressure gauge 12A and the inverter 16A. Hence, it is difficult to integrate and set up these devices, and the cost of the controller 14A also increases.

SUMMARY OF THE INVENTION

Accordingly, a primary object of the present invention is to provide a method for controlling a constant-pressure fluid, whereby an inverter is provided with a build-in controller to detect various operation conditions, such as an abnormal handling condition, a deceleration standby handling condition, or an acceleration condition. The effect of avoiding frequently starting up or shutting down the inverter not only reduces power consumption, operation cost, but also prolongs use life of a pump and implements constant-pressure control for the pump.

In order to achieve the objective mentioned above, the present invention provides a method for controlling a constant-pressure fluid, which provides an inverter with a build-in controller to control rotation speed of a pump to achieve constant-pressure control thereof. The control method comprises following steps: firstly, a pressure feedback value of output flow of the pump is measured and is compared with a pressure reference value to produce an error pressure value. Afterward, an operation condition of the pump, such as an abnormal handling condition, a deceleration standby handling condition, or an acceleration condition, is determined according to the pressure error value to shut down or re-start up the pump after a delay time. Hence, the control method can avoid frequently starting up or shutting down the inverter. Therefore not only power consumption, operation costs are reduced, but also the use life of the pump is prolonged, thus implementing constant-pressure control for the pump.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
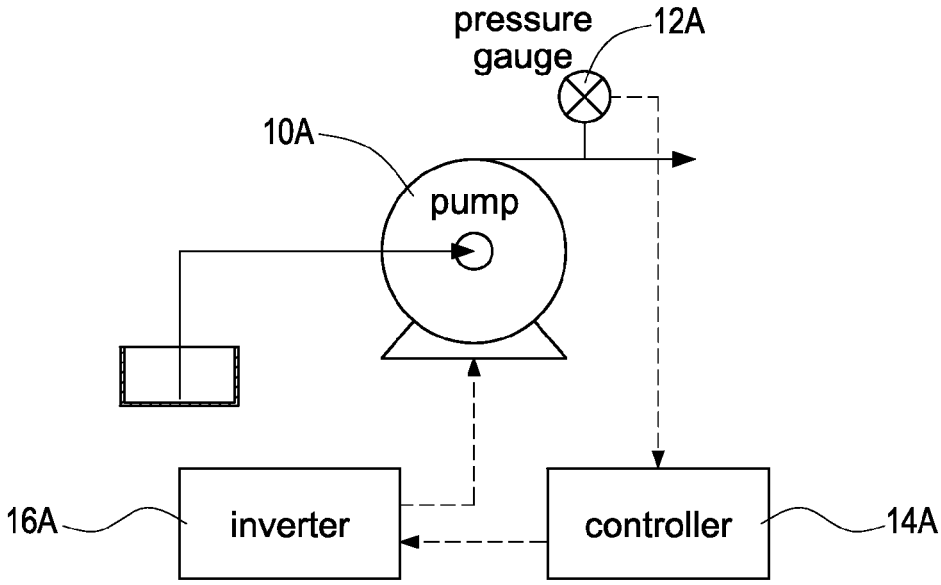
FIG.1 PRIOR ART
FIG. 1 is a block diagram of a related art constant-pressure water supply system.

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Reference will now be made to the drawing figures to describe the present invention in detail.

Figure 2:
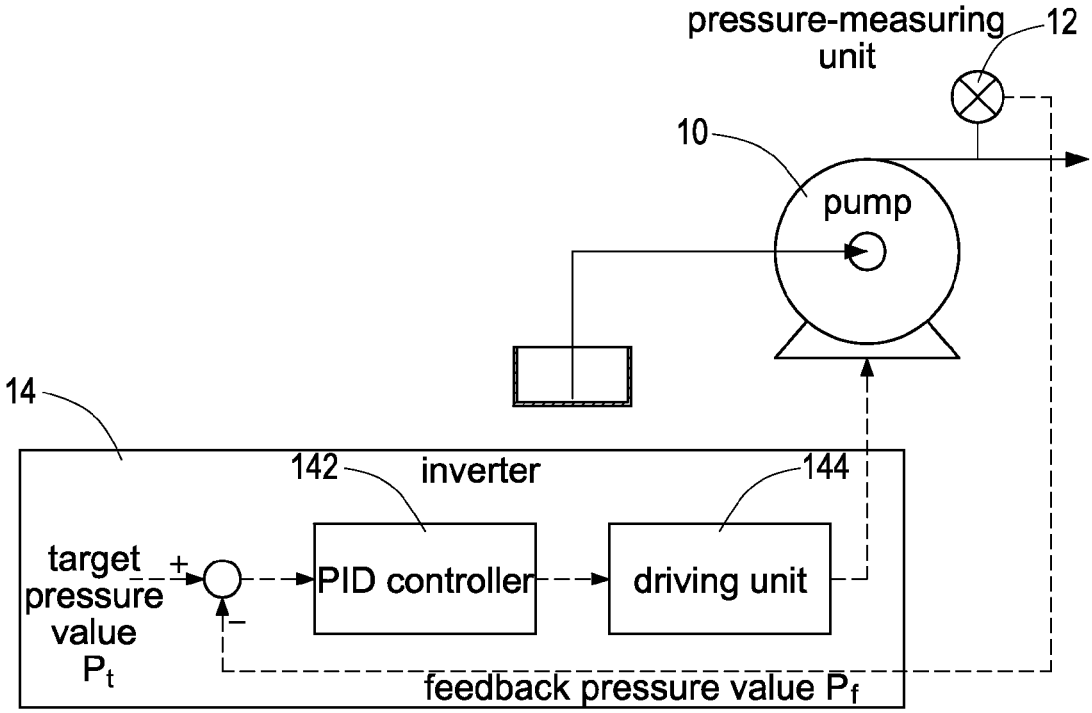
FIG. 2 is a block diagram of a constant-pressure fluid control system according to a preferred embodiment of the present invention.

Reference is made to FIG. 2 which is a block diagram of a constant-pressure fluid control system according to a preferred embodiment of the present invention. The fluid is air or liquid, and water is regarded as fluid in the present invention. The constant-pressure fluid control system comprises a pump 10, a pressure-measuring unit 12, and an inverter 14. The inverter 14 has a controller 142 and a driving unit 144, and the controller 142 is a PID controller 142. The pressure-measuring unit 12 is used to measure a water pressure value of a pipe connected to the pump 10, and the pressure value is converted into a feedback pressure value Pf and the feedback pressure value Pf is fed back to the PID controller 142. The feedback pressure value Pf is compared with a target pressure value Pt to generate an error pressure value. The error pressure value is equal to the target pressure value is subtracted from the feedback pressure value Pf. Afterward, the error pressure value is sent to the PID controller 12 and the error pressure value is calculated using a proportion, an integration, or a differentiation operation by the PID controller 12 to adjust an output frequency of the inverter 14 by the driving unit 144, whereby the rotation speed of the pump 10 is controlled to be in the constant-pressure condition. The PID controller 142 is built in the inverter 14 and the feedback pressure value Pf is fed directly to the inverter 14.

Figure 3:
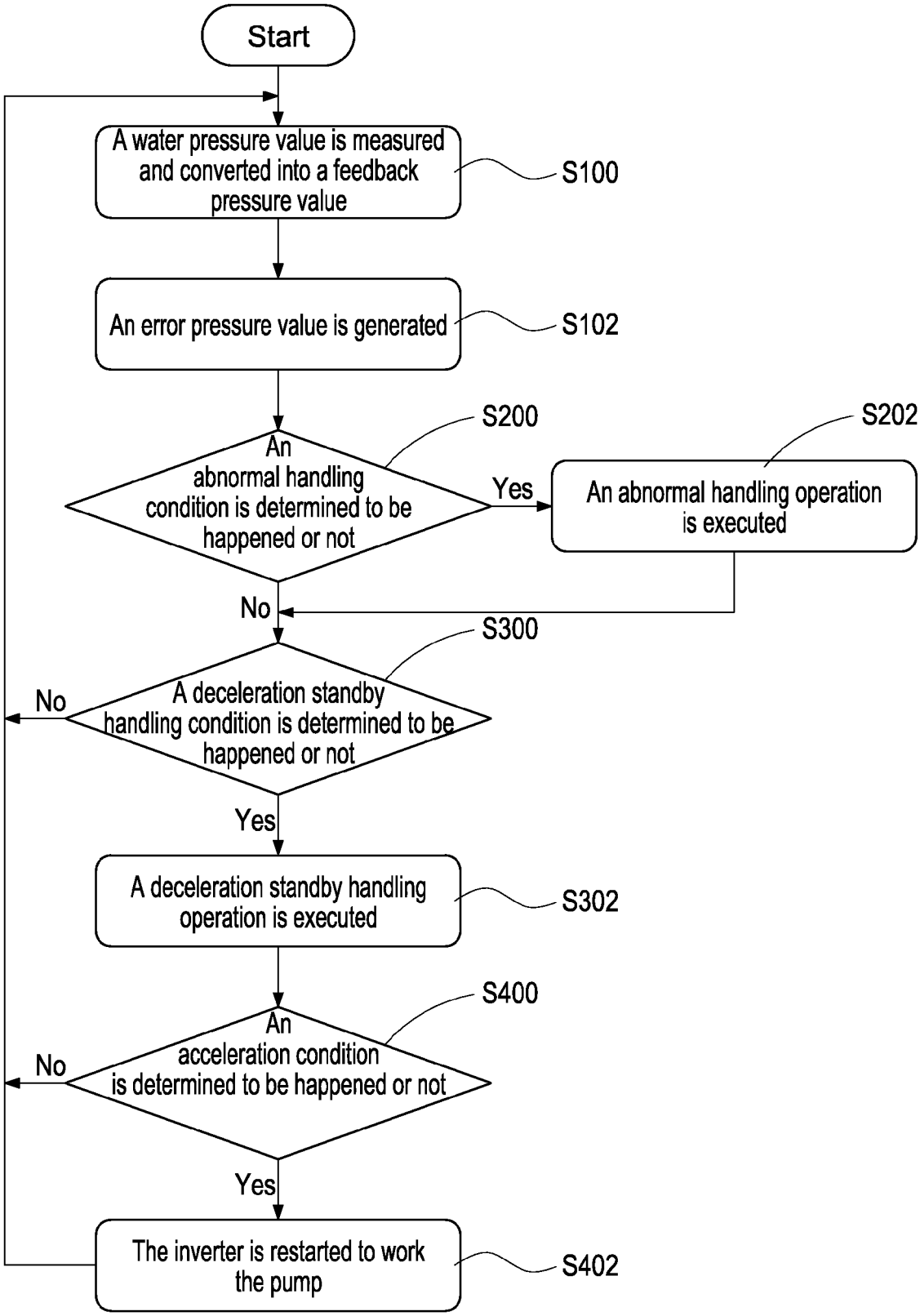
FIG. 3 is a flowchart of a method for controlling a constant-pressure fluid.

Reference is made to FIG. 3 which is a flowchart of a method for controlling a constant-pressure fluid. A pressure-measuring unit measures a water pressure value of a pipe connected to a pump, and the pressure value is converted into a feedback pressure value Pf (S100). The feedback pressure value Pf is compared with a target pressure value Pt to generate an error pressure value (S102). Afterward, the method of the present invention determines whether an abnormal handling condition happens or not (S200) according to the error pressure value. An abnormal handling operation is executed (S202) when the error pressure value is greater than or equal to an abnormal deviation quantity ΔPe and it is sustained to exceed an abnormal handling detection time Te. The abnormal handling operation is to shut down the inverter to decelerate the pump until the pump stops. Afterward, the inverter is restarted to work the pump after a re-starting delay time Td. The method of the present invention further determines whether a deceleration standby handling condition happens or not (S300) when the abnormal handling condition happens. A deceleration standby handling operation is executed (S302) when the error pressure value is less than or equal to a large-scale pressure-reducing deviation quantity ΔPm and it is sustained to exceed large-scale pressure-reducing detection time Tm. The deceleration standby handling operation is to shut down the inverter to decelerate the pump until the pump stops. The step (S100) is re-executed when the deceleration standby handling operation does not perform. Afterward, the method of the present invention determines whether an acceleration condition happens or not (S400). The inverter is restarted to work the pump (S402) when the error pressure value is greater than or equal to a small-scale pressure-reducing deviation quantity ΔPs or a variation quantity per unit time of the feedback pressure value Pf is greater than a threshold setting value. The step (S100) is re-executed when the acceleration operation does not perform.

Figure 4:
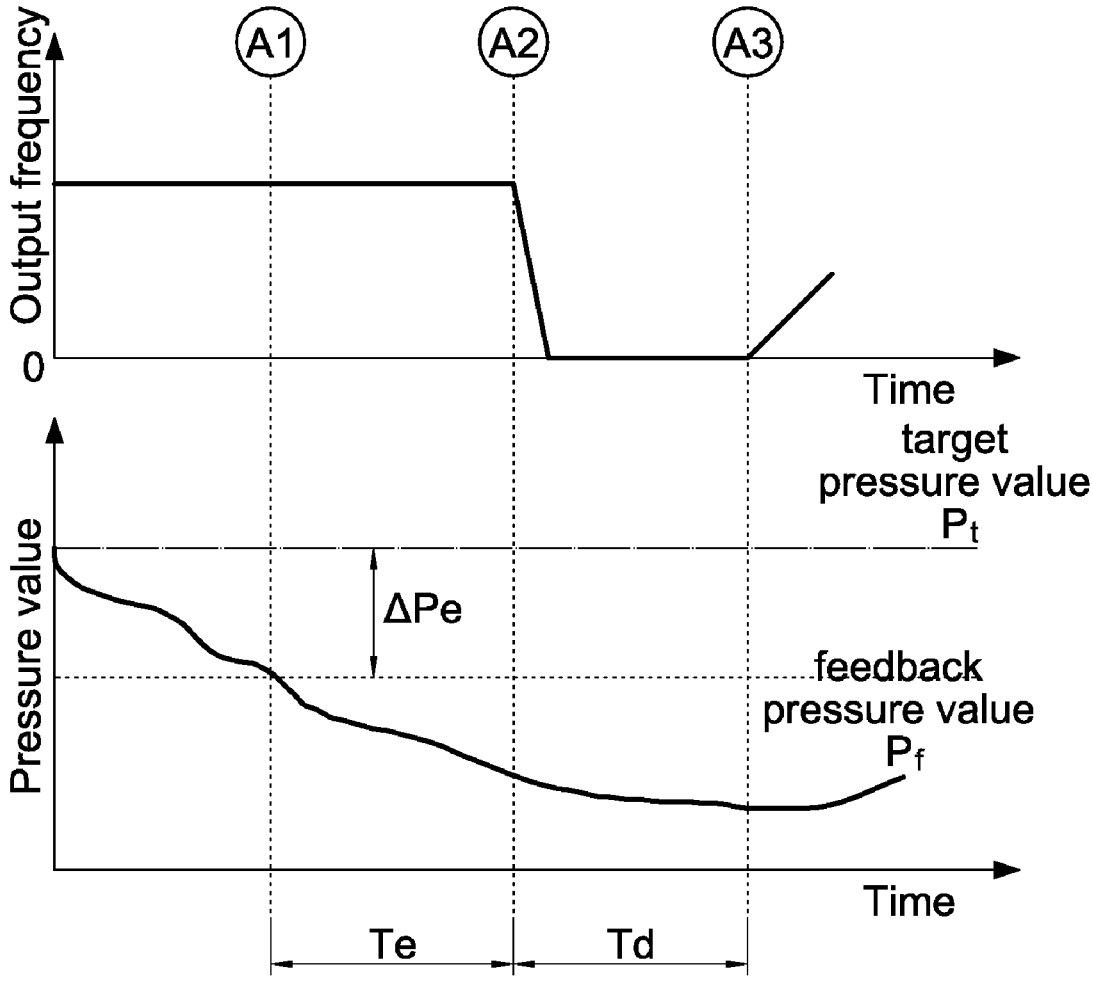
FIG. 4 is a time domain graph of an abnormal handling operation.
Figure 5:
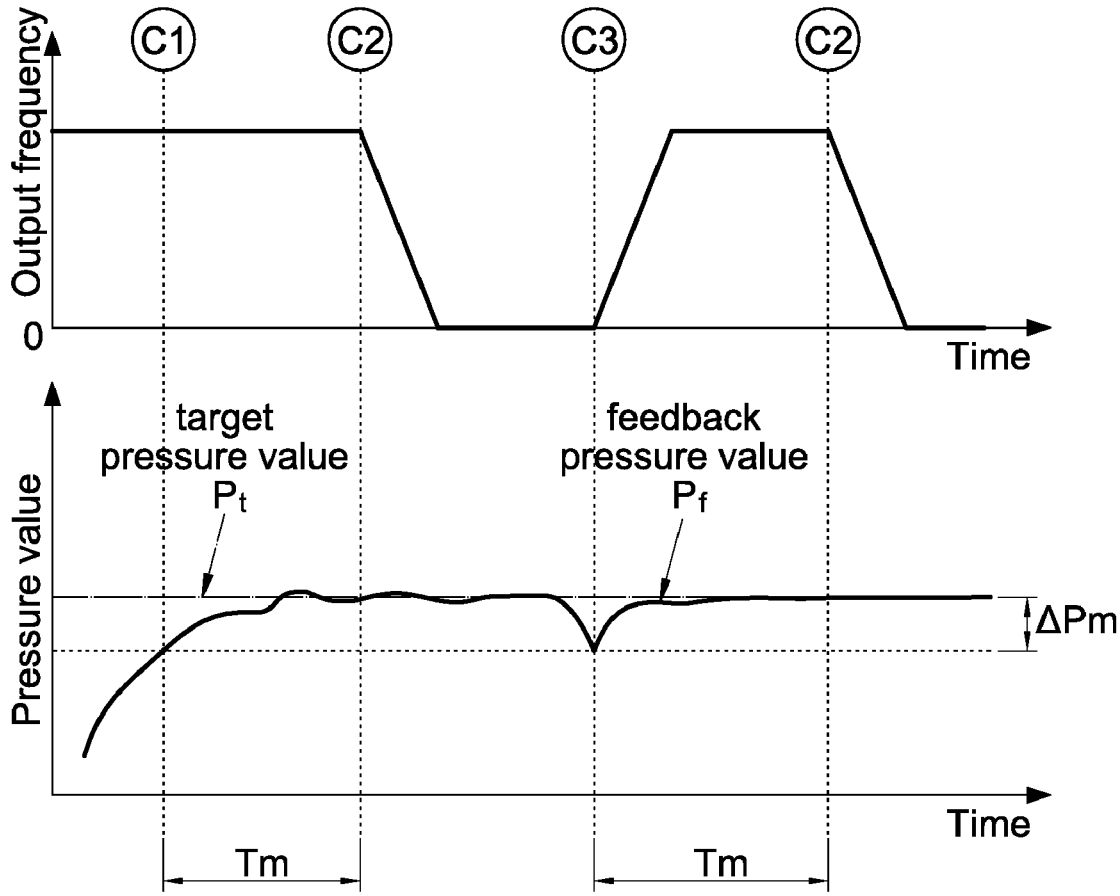
FIG. 5 is a time domain graph of a deceleration standby handling operation.

Reference is made to FIG. 4 which is a time domain graph of an abnormal handling operation. The inverter is operated into a first operation point A1 when a pressure difference between the feedback pressure value Pf and the target pressure value Pt is greater than an abnormal deviation quantity ΔPe. The inverter is operated into a second operation point A2 and an abnormal handling operation is executed when the pressure difference is increased continually after an abnormal handling detection time Te from the first operation point A1. The abnormal handling operation is to shut down the inverter to decelerate the pump until the pump stops. The inverter is restarted to work the pump into a third operation point A3 after a re-starting delay time Td from the second operation point A2. A normal constant-pressure water supply is implemented until the feedback pressure value Pf equals to the target pressure value Pt. The inverter is re-operated into the second operation A2 to shut down the inverter to decelerate the pump when the pressure difference is increased continually. Time duration of the abnormal handling detection time Te and the re-starting delay time Td can be set according to user demand. Reference is made to FIG. 5 which is a time domain graph of a deceleration standby handling operation. An output frequency of the inverter is controlled to accelerate the pump according to an outputted of the PID controller when the feedback pressure value Pf is less than the target pressure value Pt and the pressure difference between the feedback pressure value Pf and the target pressure value Pt is greater than a large-scale pressure-reducing deviation quantity ΔPm. The inverter is operated into a first operation point C1 when the pressure difference is less than the large-scale pressure-reducing deviation quantity ΔPm. After a large-scale pressure-reducing detection time Tm from the first operation point C1, the inverter is operated into a second operation point C2 to shut down the inverter to decelerate the pump when the pressure difference is continually less than the large-scale pressure-reducing deviation quantity ΔPm. The water supply system is in a constant-pressure condition when the pressure difference is still less than the large-scale pressure-reducing deviation quantity ΔPm after the pump stops. However, the inverter is operated into a third operation point C3 to re-start the inverter to accelerate the pump to increase the feedback pressure value Pf when the pressure difference is greater than the large-scale pressure-reducing deviation quantity ΔPm. Similarly, the inverter is operated into the second operation point C2 to shut down the inverter to decelerate the pump until the pump stops. In addition, the water supply system is in the constant-pressure condition when the pressure difference is continually less than the large-scale pressure-reducing deviation quantity ΔPm after the large-scale pressure-reducing detection time Tm from the third operation point C3.

Figure 6:
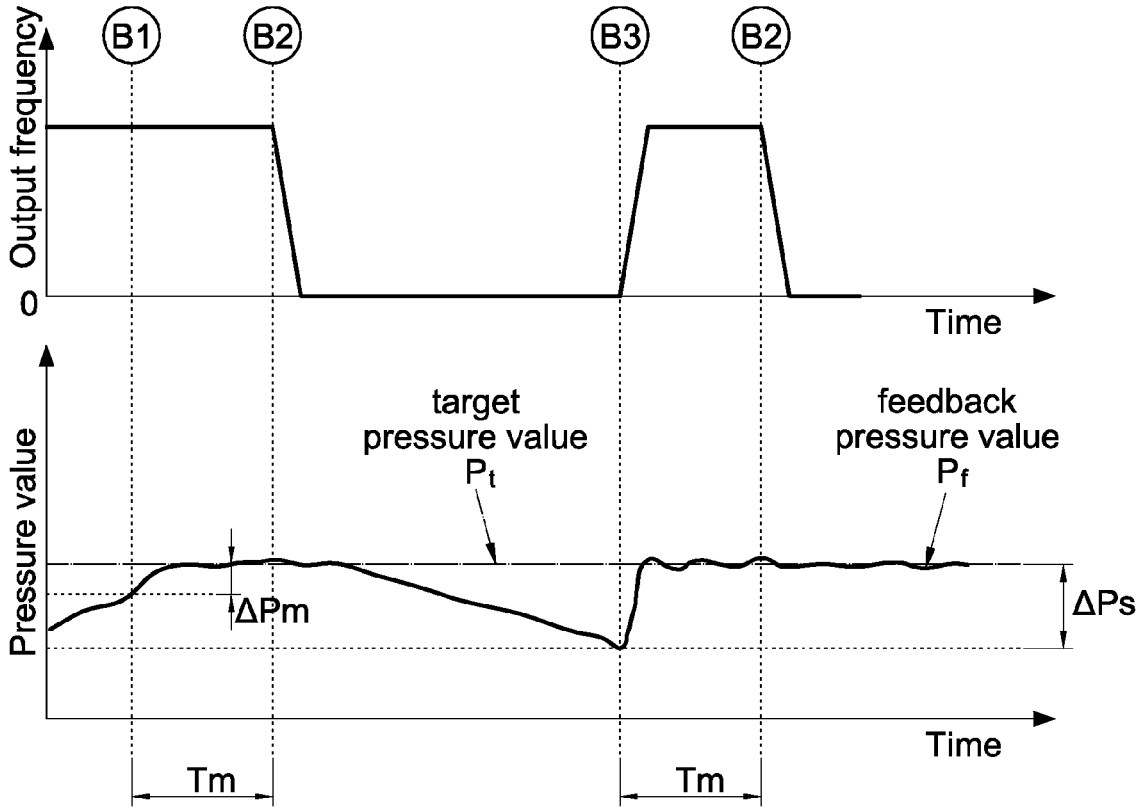
FIG. 6 is a time domain graph of a small-scale pressure-reducing handling operation.

Reference is made to FIG. 6 which is a time domain graph of a small-scale pressure-reducing handling operation. The output frequency of the inverter is controlled to accelerate the pump according to an output of the PID controller when the feedback pressure value Pf is less than the target pressure value Pt and the pressure difference between the feedback pressure value Pf and the target pressure value Pt is greater than a large-scale pressure-reducing deviation quantity ΔPm. The inverter is operated into a first operation point B 1 when the pressure difference is less than the large-scale pressure-reducing deviation quantity ΔPm. After a large-scale pressure-reducing detection time Tm from the first operation point B1, the inverter is operated into a second operation point B2 to shut down the inverter to decelerate the pump when the pressure difference is continually less than the large-scale pressure-reducing deviation quantity ΔPm. The water supply system is in a constant-pressure condition when the pressure difference is still less than the large-scale pressure-reducing deviation quantity ΔPm after the pump stops. The inverter is operated into the second operation point B2 when the feedback pressure value Pf is decreased slightly, namely, a variation quantity per unit time of the feedback pressure value Pf is less than a small-scale pressure-reducing threshold value. This condition can be treated as a small-scale water consumption or an abnormal water leakage. Hence, the inverter is still operated into the second operation point B2 even if the pressure difference is greater than the large-scale pressure-reducing deviation quantity ΔPm. Until the pressure difference is greater than a small-scale pressure-reducing deviation quantity ΔPs, the inverter is operated into a third operation point B3 to re-start up the inverter to accelerate the pump to increase the feedback pressure value Pf. Similarly, the inverter is operated into the second operation point B2 to shut down the inverter to decelerate the pump when the pressure difference is less than the large-scale pressure-reducing deviation quantity ΔPm.

In conclusion, the present invention has the following advantages:

It is to provide an inverter with a build-in controller to detect various operation conditions, such as an abnormal handling condition, a deceleration standby handling condition, or an acceleration condition. The effect of avoiding frequently stating up or shutting down the inverter not only reduces power consumption, operation cost, but also prolongs use life of a pump and implements constant-pressure control for the pump.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for controlling a constant-pressure fluid to provide an inverter to control rotation speed of a pump, the method comprising the steps of:

(a) measuring an output pressure value of the pump and converting the outputted pressure value into a feedback pressure value;

(b) comparing the feedback pressure value with a target pressure value to generate an error pressure value, and sending the error pressure value to a build-in controller of the inverter for calculation so as to adjust an output frequency of the inverter by a driving unit of the inverter;

(c) shutting down the inverter to stop the pump in response to the error pressure value is greater than or equal to an abnormal deviation quantity sustaining to exceed an abnormal handling detection time, and afterward the inverter is restarted to accelerate the pump after a re-starting delay time;

(d) shutting down the inverter to stop the pump in response to the error pressure value is less than or equal to a large-scale pressure-reducing deviation quantity sustaining to exceed a large-scale pressure-reducing detection time; and (e) starting the inverter to accelerate the pump if the error pressure value is greater than or equal to a small-scale pressure-reducing deviation quantity, or a variation quantity per unit time of the feedback pressure value is greater than a threshold setting value according to the error pressure value.

2. The method for controlling a constant-pressure fluid in claim 1, wherein the fluid is air or liquid.

3. The method for controlling a constant-pressure fluid in claim 2, wherein the liquid is water.

4. The method for controlling a constant-pressure fluid in claim 1, wherein the output pressure value is measured by a pressure gauge.

5. The method for controlling a constant-pressure fluid in claim 1, wherein the controller is a PID controller.

* * * * *